United States Patent [19]

Vipond et al.

[11] Patent Number: 4,775,492

[45] Date of Patent: Oct. 4, 1988

[54] THICKENED LIQUID BLEACHING COMPOSITION

[75] Inventors: Peter W. Vipond; James R. Trueman, both of Wirral; John S. Parsons, Birkenhead, all of Great Britain

[73] Assignee: Lever Brothers Company, New York, N.Y.

[21] Appl. No.: 12,395

[22] Filed: Feb. 9, 1987

[30] Foreign Application Priority Data

Feb. 11, 1986 [GB] United Kingdom ..... 8603300

[51] Int. Cl.[4] ..... C11D 3/395

[52] U.S. Cl. ..... 252/187.26; 252/95; 252/96; 252/98; 252/94; 252/187.25; 252/187.27; 252/DIG. 14

[58] Field of Search ..... 252/96, 98, 94, 95, 252/367, 187.21, 187.25, 187.26, 187.27, 187.29, 187.31, DIG. 14

[56] References Cited

U.S. PATENT DOCUMENTS 3,684,722 8/1972 Hynam ..... 252/98
4,129,520 12/1978 Peterson ..... 252/367
4,588,514 5/1986 Jones ..... 252/98

FOREIGN PATENT DOCUMENTS 0030401 6/1981 European Pat. Off. .
1329086 9/1973 United Kingdom .
1466560 3/1977 United Kingdom .
2003522A 3/1979 United Kingdom .
1548379 7/1979 United Kingdom .
2076010A 11/1981 United Kingdom .

*Primary Examiner*—John F. Niebling
*Assistant Examiner*—Isabelle Rodriguez
*Attorney, Agent, or Firm*—Gerard J. McGowan; James J. Farrell

[57] ABSTRACT

The invention provides a process for preparing a thickened liquid bleaching composition with a low initial viscosity during manufacturing and an increased final viscosity, using a hypochlorite-soluble detergent-active material and a soap, whereby the soap is partly or completely caused to be formed in situ in the composition by incorporating therein a material which generates fatty acid in the composition. Typical examples of such materials are fatty acid esters of lower alcohols.

2 Claims, No Drawings

THICKENED LIQUID BLEACHING COMPOSITION

The present invention relates to improved thickened liquid bleaching compositions. More particularly, it relates to such bleaching compositions which have been thickened to a certain viscosity by the inclusion of a thickening system comprising at least two different detergent-active materials, one of which is an alkali metal fatty acid salt.

Such thickening systems containing alkali metal soap are known from the prior art, e.g. EP-A1-No. 00 30401, GB Pat. Nos. 1,329,086, 1 466 560, 2 003 522, 2 076 010, and a typical thickening system is a mixture of a tertiary amine oxide and a fatty acid soap as described in GB Pat. No. 1,329,086. With such thickening systems a viscosity of about 10–150 cS can be achieved.

However, if higher viscosities were to be required, then higher levels of the thickening system would be required which increase the cost of such products. Moreover, higher viscosities would lead to manufacturing and packing problems, in that thicker products would have to be handled and packed.

It has now been found that thickened liquid bleaching compositions with an increased final viscosity and a sufficiently low initial viscosity to enable easy manufacturing and packing can be obtained by using, instead of an alkali metal fatty acid salt, a material that generates fatty acid in situ in the bleaching compositions.

By partial or complete replacement of the alkali metal fatty acid salt by this material that generates fatty acid in situ, low initial viscosities and increased final viscosities can be obtained.

The present invention therefore relates, in its broadest sense, to a process for preparing thickened, aqueous bleaching compositions having an initial low viscosity and an increased final viscosity, such compositions containing a thickening system comprising hypochlorite-soluble detergent-active material and an alkali metal salt of a fatty acid, characterised in that the alkali metal salt of the fatty acid is partly or completely caused to be formed in situ in the compositions by the incorporation thereof of a material which generates fatty acid in situ in the compositions.

The material generating fatty acid can be any material that in the liquid bleaching compositions produces a fatty acid during storage of the compositions. The material is not a detergent-active material itself, and generates the fatty acid in situ through hydrolysis, degradation, oxidation or whatever other decomposition mechanism. Typical classes of compounds that can generate fatty acids in situ in the liquid bleaching compositions are esters of long-chain fatty acids with short-chain alcohols, long-chain aliphatic aldehydes and ketones, long-chain olefins, long-chain nitriles etc. Naturally, the alkyl chain of these materials should correspond with the fatty acids hitherto added as such to the liquid bleaching compositions, i.e. saturated fatty acids having 8–20 carbon atoms. Suitable examples are e.g. methyl laurate, isopropyl laurate, sec-butyl laurate, neopentyl laurate.

These materials, hereinafter referred to as "soap precursors", should generate fatty acids in the compositions to be thickened. These compositions may have a pH of 2–13.5, depending upon the type of bleaching agent used therein. For peroxy-type bleaching agents, usually these products have an acid pH, whereas for chlorine-type bleaching agents, these products have an alkaline pH. It is particularly for products of the latter type that the present invention is especially suitable.

The soap precursor can partly or completely replace the soap component hitherto used in the thickened bleaching composition. In practice, the best way of formulating a precursor system is first to formulate with the soap and without the precursor to the desired viscosity and cloud point, and then to replace the soap by an equimolar amount of precursor, the level of replacement being governed simply by the initial viscosity desired.

In general, the final viscosity of the thickened bleaching composition should be within the range of 100–500 cS (as measured at 25° C. in an Ostwald E-tube), and the initial viscosity should be below 100 cS. The viscosity rise during the first 8 hours of storage of the product at 25° C. after the addition of the soap precursor should be such that the viscosity after these 8 hours is at least 2 times the initial viscosity. When the soap precursor is used as a partial replacement of the soap, the viscosity after 8 hours is generally between 2 and 3 times the initial viscosity.

It is, of course, essential in the process of the invention to prevent premature generation of the fatty acid material in situ. Thus the material generating fatty acid should be added either in the final mixing stage, or the free alkali and the bleaching agent should be added last.

The detergent-active material present in the thickening system can be any suitable hypochlorite-soluble detergent such as tertiary amine oxides, alkyl- and alkylethersulphates, betaines, carboxylated nonionics, alkyl- or alkyletherphosphates, sarcosinates, taurides, sucrose esters etc. The amounts thereof usually range from 0.5–5%, preferably from 0.5–3% by weight.

The preferred detergent-active materials are the tertiary amine oxides as described in GB Pat. No. 1,329,086. The amount of bleaching agent ranges from 1–50%, for chlorine bleaching agents 1–15% being a normal range.

The compositions of the invention may furthermore contain the usual additives such as dyes, pigments, perfumes, buffer salts etc.

The invention will further be illustrated by way of example.

EXAMPLE 1

The following products were made by mixing the following ingredients:

| | % by weight | |
|---|---|---|
| | A | B |
| lauryl dimethylamine oxide | 1.140 | 1.14 |
| sodium laurate | 0.500 | 0.424 |
| isopropyl laurate | — | 0.082 |
| sodium hydroxide | 0.7 | 0.7 |
| perfume | 0.03 | 0.03 |
| sodium hypochlorite | 9.0 | 9.0 |
| demineralised water | to 100 | to 100 |

The cloud point of A was 43° C., and of B 60° C.

The initial viscosity of A was 220 cS (at 25° C.), and B had an initial viscosity of only 20 cS. After 4 days, A reached a peak viscosity of 290 cS, and after 30 days its viscosity was 210 cS.

Product B reached a peak viscosity of 270 cS after 12 days, and had a viscosity of 240 cS after 30 days.

A series of formulations was made, using a lauryl dimethylamine oxide (AO) and lauric acid (LA) in a weight ratio of 70:30 at two different total levels, viz 1.5% (A) and 1.8% (B) by weight. The lauric acid was also partly replaced by several levels of isopropyl laurate (IPL). The formulations all contained 9% sodium hypochlorite, 0.03% perfume and 0.7% free NaOH. All products were stored at 20° C. and their viscosities were measured regularly. The following results were obtained:

| | LA/IPL ratio | viscosity (cS) initial | after 6 days | after 13 days | after 23 days |
|---|---|---|---|---|---|
| Formulation A | | | | | |
| 1 | 100/0 | 225 | 275 | 260 | 250 |
| 2 | 90/10 | 87 | 230 | 260 | — |
| 3 | 87.5/12.5 | 50 | 212 | 260 | 250 |
| 4 | 85/15 | 25 | 205 | 250 | — |
| 5 | 80/20 | 10 | 180 | 235 | 250 |
| Formulation B | | | | | |
| 1 | 100/0 | 330 | 380 | 380 | 350 |
| 2 | 90/10 | 170 | 325 | 360 | 348 |
| 3 | 87.5/12.5 | 115 | 312 | 360 | 338 |
| 4 | 85/15 | 55 | 290 | 338 | 338 |
| 5 | 80/20 | 25 | 275 | 328 | 348. |

EXAMPLE 3

The following products were prepared, and their viscosities measured:

| | | | |
|---|---|---|---|
| lauryl dimethylamine oxide | 1.65 | 1.65 | 1.65 |
| lauric acid | 0.338 | 0.432 | 0.442 |
| methyl laurate | 0.182 | — | — |
| isopropyl laurate | — | 0.088 | — |
| sec-butyl laurate | — | — | 0.078 |
| free NaOH | 1.08 | 1.08 | 1.08 |
| sodium hypochlorite | 10 | 10 | 10 |
| water | to 100 | to 100 | to 100 |
| viscosity (cS; 25° C.) | | | |
| initial | 20 | .10 | 7.5 |
| after 60 hours | 212 | 160 | 56 |

EXAMPLE 4

The following formulations were prepared:

| | % w/w |
|---|---|
| lauryl dimethylamine oxide | 1.38 |
| sodium laurate | 0.388 |
| soap precursor | molar equivalent to 0.069 sodium laurate |
| free NaOH | 1.00 |
| sodium hypochlorite | 10.00 |
| demineralised water | to 100. |

The following soap precursors were used, and were added at:

| | |
|---|---|
| methyl laurate | 0.066% |
| isopropyl laurate | 0.074% |
| sec-butyl laurate | 0.078% |

The viscosity* and cloud point* data collected on the products containing these precursors and stored at 25° C. were as follows. For comparison, the controls were also used, one with no replacement of sodium laurate (i.e. sodium laurate level of 0.456%) and one with no addition of precursor (i.e. sodium laurate level of 0.388% but no precursor).

*Viscosity data measured in cS using an Ostwald E-tube. Cloud point data taken as temperature above which product is phase separated.

| Time (hrs) | Control 1 0.45% NaL | Control 2 0.388% NaL | Methyl Laurate | Isopropyl Laurate | Sec-Butyl Laurate |
|---|---|---|---|---|---|
| 0 | 100 cS/64° C. | 48 cS/79° C. | 48 cS/67° C. | 12 cS/77° C. | 9 cS/77° C. |
| 1 | 111 | 52 | 73 | 16 | 11 |
| 2 | 119 cS/66° C. | 58 cS/77° C. | 90 cS/65° C. | 18 cS/74° C. | 13 cS/75° C. |
| 3 | 126 | — | 100 | 21 | 14 |
| 4 | 130 | 65 | 108 | 24 | 16 |
| 5 | 135 | — | 114 | 27 | 17 |
| 6 | 136 | 69 cS/74° C. | 118 | 29 | 19 |
| 7.5 | 140/66° C. | — | 122 cS/63° C. | 33 cS/71° C. | 21 cS/73° C. |
| 24 | 152/64° C. | 73 cS/74° C. | 137 cS/64° C. | 77 cS/67° C. | 40 cS/70° C. |

EXAMPLE 5

Using methyl laurate as a total replacement for the sodium laurate in the formulation of Example 4, i.e. a level of 0.439% methyl laurate, gave the following results:

| | |
|---|---|
| initial viscosity | 2 cS |
| viscosity after 4 hours | 50 cS |
| viscosity after 8 hours | 105 cS |
| viscosity after 24 hours | 140 cS |

We claim:

1. Process for preparing thickened aqueous bleaching compositions comprising 1–15% by weight of sodium hypochlorite by thickening an aqueous sodium hypochlorite solution with a thickening system comprising 0.5–5% by weight of a hypochlorite-soluble detergent-active material and an alkali metal salt of a fatty acid, wherein the alkali metal salt of the fatty acid is partly or completely caused to be formed in situ by hydrolysis in the composition by the incorporation therein of a non-detergent-active ester selected from the group consisting of methyl laurate, isopropyl laurate, sec.-butyl laurate and neopentyl laurate which generates fatty acid in situ in the composition.

2. Process according to claim 1, wherein the alkali metal salt of the fatty acid is partly formed in situ by adding the ester, the balance of the required alkali metal salt of the fatty acid being added in the form of a soap.

* * * * *